United States Patent [19]

Kelly

[11] Patent Number: 4,502,308

[45] Date of Patent: Mar. 5, 1985

[54] SWAGING APPARATUS HAVING ELASTICALLY DEFORMABLE MEMBERS WITH SEGMENTED SUPPORTS

[75] Inventor: John W. Kelly, LaCanada, Calif.

[73] Assignee: Haskel, Inc., Burbank, Calif.

[21] Appl. No.: 341,795

[22] Filed: Jan. 22, 1982

[51] Int. Cl.[3] ..... B21D 39/08

[52] U.S. Cl. ..... 72/58; 72/62; 72/370; 29/421 R

[58] Field of Search ..... 72/57, 58, 61, 62, 370; 29/421 R, 157.4, 523

[56] References Cited

U.S. PATENT DOCUMENTS

| | | | |
|---|---|---|---|
| 2,460,580 | 2/1949 | Huber | 29/421 R |
| 2,941,568 | 6/1960 | Ottstad | 72/58 |
| 3,051,112 | 8/1962 | Van Leer | 72/62 |
| 3,193,917 | 7/1965 | Loomis | 29/421 R |
| 3,986,383 | 10/1976 | Petteys | 72/393 |
| 4,393,674 | 7/1983 | Rosmussen | 29/421 R |

FOREIGN PATENT DOCUMENTS 1939105 2/1970 Fed. Rep. of Germany .

*Primary Examiner*—Leon Gilden
*Attorney, Agent, or Firm*—Pretty Schroeder Brueggemann & Clark

[57] ABSTRACT

A swaging apparatus includes a mandrel to be inserted in a tubular structure that is to be expanded radially. A pair of seals define the axial boundaries of an annular pressure zone between the mandrel and the tubular structure. One or both of the seals includes a support formed by a plurality of arcuate segments elastically held together and presenting a cam surface. A cam member interacts with the cam surface to expand the support radially in response to swaging pressure, thereby preventing inelastic deformation of an elastic member on the high pressure side of the support.

23 Claims, 6 Drawing Figures

SWAGING APPARATUS HAVING ELASTICALLY DEFORMABLE MEMBERS WITH SEGMENTED SUPPORTS

FIELD OF THE INVENTION

The present invention relates to swaging devices for radially expanding tubular structures, and, more particularly, to such devices in which a mandrel is inserted in the structure to be expanded and pressure is applied.

BACKGROUND OF THE INVENTION

There are a variety of situations in which it is desired to expand a metal tube radially to form a tight, leak-free joint. For example, large heat exchangers, particularly the type used as steam generators in nuclear power plants, often employ a tube sheet, which is a steel plate several feet thick, through which hundreds of stainless steel or carbon steel tubes must pass. The tube sheet is initially fabricated with bores of a suitable diameter in which the tubes are inserted. The tubes are then expanded against the sides of the bores by plastic deformation to seal the small crevices that would otherwise exist around the tubes. If these crevices were allowed to remain, they could collect corrosive agents, and would, therefore, decrease the reliable and predictable life-expectancy of the equipment.

In general, the most effective state of the art apparatus for difficult swaging jobs that require high magnitude forces employ a mandrel that is inserted in the tube. Pressurized hydraulic fluid is then introduced to an annular volume or pressure zone between the mandrel and the tube, forcing the tube to expand radially.

Each such mandrel requires two seals that define the axial boundaries of the pressure zone. The construction of these seals presents unusually difficult technical problems because materials that have the necessary elastic properties to prevent leakage of the hydraulic fluid tend to extrude into any available gaps or small volumes and deform inelastically, thus damaging the seal.

It has been found to be desirable to use two element seals. The primary seal element, which comes into direct contact with the hydraulic fluid is relatively soft. Usually, a rubber O-ring is used. An adjacent element, referred to as a backup member, is more rigid but still behaves elastically at the high pressures applied to it. A polyurethane ring is well suited to this use. It is compressed axially by the swaging pressure and expands radially as the tube expands.

While a backup member prevents extrusion damage to the primary seal element, it has been found that at high swaging pressures the backup member itself may be inelastically deformed by extrusion into an adjacent annular gap on the low pressure side of the seal that necessarily widens as the tube expands.

An objective of the present invention is to provide an improved swaging apparatus in which the problem of destructive inelastic extrusion of the elastic element or elements of the seal is minimized or eliminated.

SUMMARY OF THE INVENTION

The present invention accomplishes the above objective. It includes a swaging mandrel to be inserted axially in a tubular structure, thereby defining a pressure zone extending axially along the mandrel and the surrounding structure. Preferably the mandrel defines a conduit by which pressurized hydraulic fluid can be introduced into an annular volume between the mandrel and the tube. Defining the axial boundaries of the pressure zone are a pair of seals, one or both of which includes a support formed by a plurality of arcuate segments. Upon the application of a longitudinal force attributable to the swaging pressure, these segments are spread out radially, against the inside of the tubular structure, closing off the extrusion gap between the mandrel and the tubular structure. Preferably, the segments are made of an inelastic material such as steel. They can be made to pivot at the end of the support farthest from the pressure zone so that the end closest to the zone expands radially.

According to another aspect of the invention, the support segments are urged against the mandrel by an elastic band, preferably made of polyurethane, that encircles the support. In a preferred embodiment, the band is received by an annular groove in the outside of the support, nearest the end of the support away from the pressure zone.

On the high pressure side of the support is at least one elastic member that forms a fluid tight seal and would be apt to be damaged by inelastic deformation were it not for the support. In a preferred embodiment, there are two such elastic members, the softer of the two being on the high pressure side. One elastic member, the primary seal member, can be an O-ring, while the other, the backup member, can be a polyurethane ring.

A cam means is used to engage the support and spread the segments. In a preferred embodiment, the cam means is an inelastic cam ring between the support on one side and the elastic members on the other. Conical cam surfaces on the support and the cam ring engage each other to produce an outwardly directed radial force applied to the support segments in response to a primarily axially hydraulic force.

According to still another aspect of the invention, the cam ring includes an elongated foot that extends axially along the mandrel. Although the foot can slide along the mandrel, it cannot move angularly. It, therefore, performs a centering function with respect to the support. The foot is received by an annular recess formed by an undercut portion of the support at the end of the support nearest the pressure zone.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
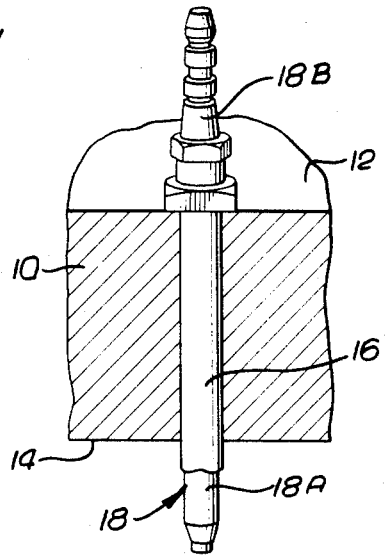
FIG. 1 is a perspective view of a swaging mandrel inserted in a tube in a bore of a tube sheet, only a fragmentary portion of the tube sheet being shown and the tube being broken away to expose one end of the mandrel.

A thick steel tube sheet 10 of the type used in heat exchangers, such as those that form part of nuclear power plants, has a plurality of bores that extend through it perpendicularly to its primary and secondary surfaces 12 and 14, respectively. A plurality of steel tubes 16 are positioned in these bores to be expanded radially by hydraulic swaging to form leak-proof joints that prevent fluid from migrating from the secondary side 14 of the exchanger to the primary side 12. A fragmentary portion of the tube sheet 10 receiving a single tube 16 is shown in FIG. 1.

Figure 2:
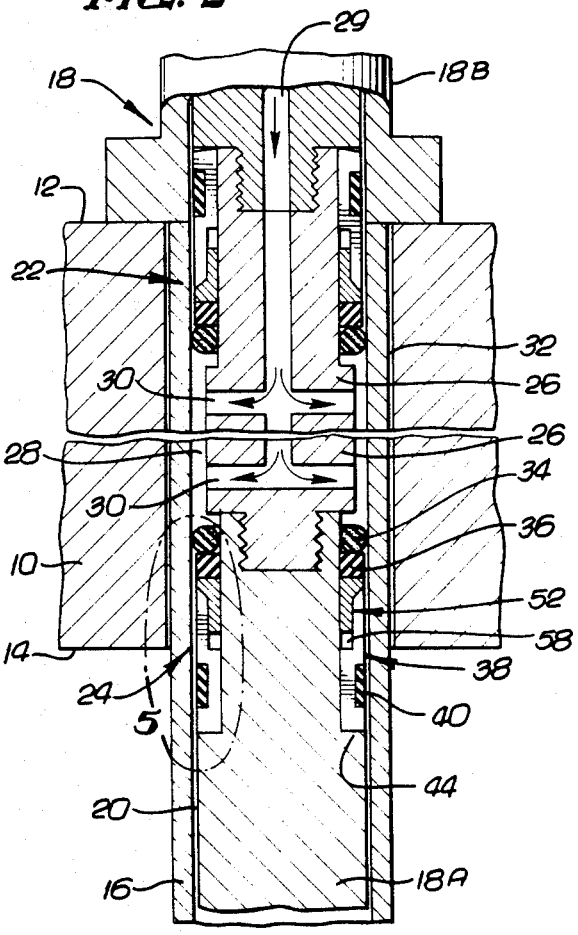
FIG. 2 is a longitudinal cross-sectional view of the mandrel, tube and tube sheet of FIG. 1, the mandrel being in position to begin swaging, a center portion of the entire structure being omitted to reduce its size.

A swaging mandrel 18 having an elongated generally cylindrical body 18A and a head 18B is inserted axially in the tube 16 from the primary side 12 of the tube sheet 10. As best shown in FIG. 2, a small annular clearance 20 exists between the mandrel body 18A and the tube 16. Between two axially spaced seals 22 and 24, a central portion 26 of the mandrel body 18A is of reduced diameter to provide an enlarged annular space that serves as a pressure zone 28. An axially oriented central conduit 29 through the mandrel 18 is connected by cross bores 30 to the pressure zone 28 to introduce pressurized hydraulic fluid to this zone.

Figure 5:
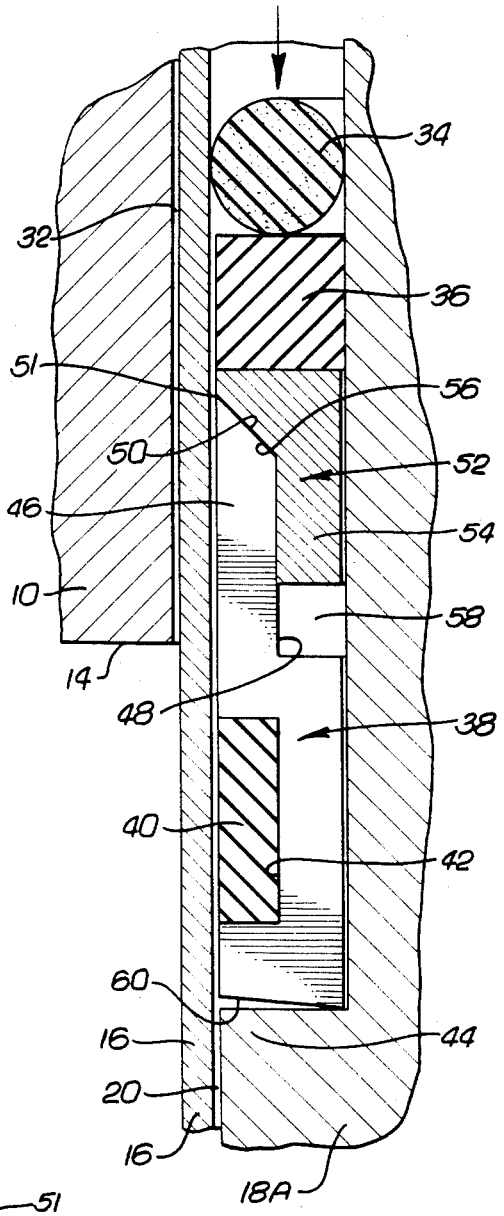
FIG. 5 is an enlargement of a fragmentary portion of the structure of FIG. 2 indicated by the arrow 5.

When swaging pressure is applied, sometimes in excess of 50,000 psi, the tube 16 is deformed radially outwardly, closing a small clearance 32 that previously existed between the tube and the tube sheet 10 (see FIGS. 2 and 5). Preferably the bore is then enlarged by elastically deforming the tube sheet 10 so that the tube 16 is permanently clamped in place when the pressure is removed and the tube sheet returns to its original shape. It is, of course, essential to this procedure that the fluid be confined within the pressure zone 28 by the seals 22 and 24. These seals 22 and 24 must be capable of being reused repeatedly after being subjected to extremely high hydraulic pressure.

Figure 3:
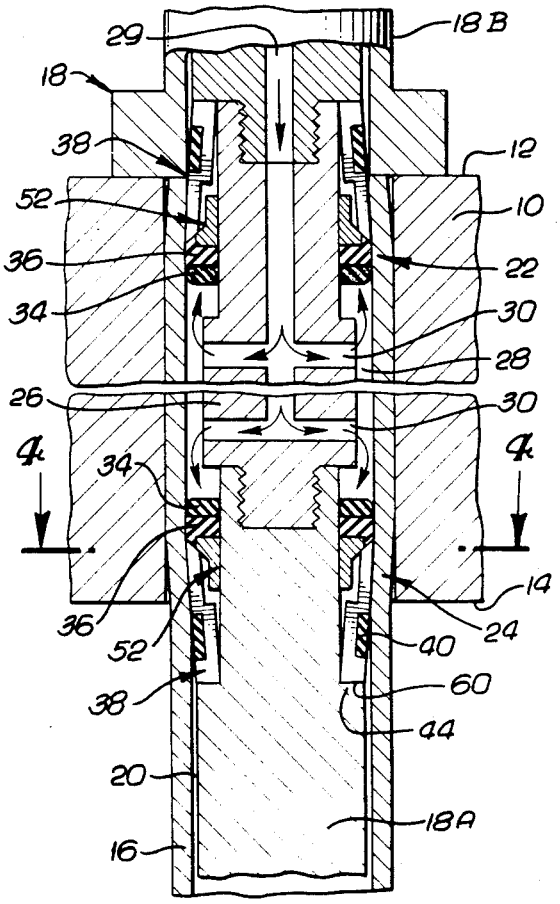
FIG. 3 is another longitudinal cross-sectional view similar to FIG. 2 showing the mandrel, tube and tube sheet after swaging has taken place and while the swaging pressure is still being applied.

Since the two seals 22 and 24 are of the same construction, only one seal 24 is described in detail here. A first and primary elastic seal member 34, making direct contact with the hydraulic fluid confined within the pressure zone 28, is soft and resilient. In this embodiment, it is a rubber O-ring. It is capable of withstanding the swaging pressure provided that it is not exposed, while the pressure is being applied, to any volume into which it could extrude beyond its elastic limits. Because of its softness, it seals tightly against the inside of the tube 16 to prevent leakage of the hydraulic fluid. However, a potential extrusion gap is formed by the clearance 20 between the mandrel body 18A and the tube 16 that is necessary to permit the mandrel to be inserted. Moreover, as the tube 16 expands radially, as shown in FIG. 3, this clearance 20 increases significantly.

Figure 6:
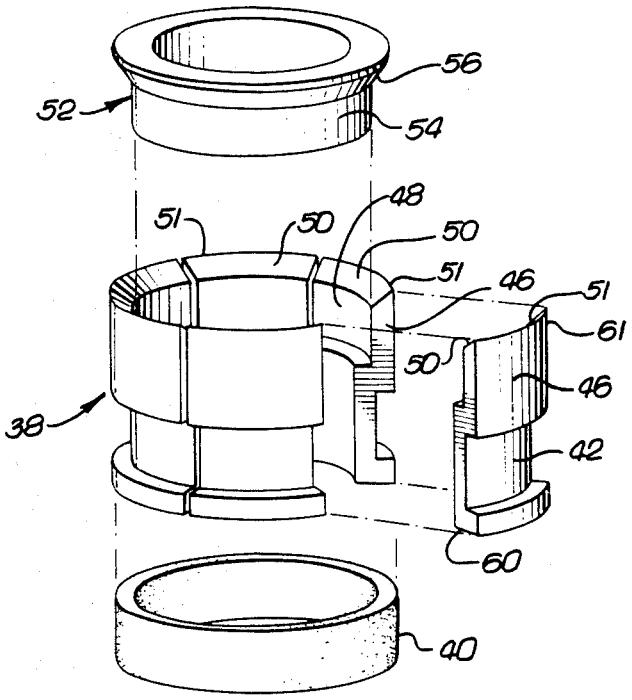
FIG. 6 is an exploded view of various components of the seal of FIG. 2.

To prevent destructive deformation of the O-ring 34, a second elastic seal member known as backup member 36 is provided on the low pressure side of the O-ring (the side away from the pressure zone 28). The backup member 36 which is a polyurethane ring, is much harder than the O-ring 34, having an exemplary hardness of about 70 Shore D, but it will deform in a plastic manner at high pressure. Thus the backup member 36, when compressed axially by the force of the hydraulic fluid, will expand radially, maintaining contact with the tube 16. Due to the extremely high swaging pressure, the backup member 36 could be deformed inelastically and destructively into the gap between the mandrel 18 and the tube 16. This extrusion gap is closed, however, by a support 38 formed by a plurality of separate arcuate segments assembled side by side to make a cylinder that encircles the mandrel 18. The support 38 is first manufactured as a complete integral cylinder which is then cut longitudinally to form the individual segments (see FIG. 6).

When the segments of the support 38 are assembled about the mandrel body 18A, they are secured and urged against the mandrel by an encircling elastic polyurethane band 40 that is stretched about fifty percent from its relaxed diameter. The band 40 is received by a circumferential groove 42 in the outside of the support 38 near the heel end of the support farthest from the pressure zone 28. Adjacent the heel end of the support 38 is a shoulder 44 that restrains the support against axial movement along the mandrel 18 in response to swaging pressure, the mandrel being disassemblable at this point to permit the seal 24 to be installed.

At the other end of the support 38 is an undercut portion 46 that defines an annular recess 48. At the mouth of the recess 48 is a conical cam surface 50 that is inclined radially outwardly and toward the pressure zone 28 forming a pointed edge 51 at the leading end of the support 38. Between the backup member 36 and the support 38 is an inelastic steel cam ring 52 with an elongated cylindrical foot 54 that extends well into the recess 48 and a conical cam surface 56 projecting outwardly from the foot to the edge 51.

When no swaging pressure is being applied (as in FIGS. 2 and 5) and the support 38 is held tightly against the mandrel body 18A by the band 40, the mating cam surfaces 50 and 56 of the support 38 and the cam ring 52 are parallel and in full engagement with each other. An unused travel space 58 remains within the recess 48 at the far end of the foot 54. Upon the application of swaging pressure, the O-ring 34, backup member 36 and cam ring 52 move axially in unison toward the shoulder 44, but the support 38 cannot move. The foot 54 of the cam ring 52 moves into the travel space 58. Interaction of the cam surfaces 50 and 56 causes the segments of the support 38 to pivot at the heel ends thereof farthest from the pressure zone 28 (FIG. 3), the back surfaces 60 of the segments being angled away from the shoulder 44 to permit this pivoting motion. As the segments move outwardly, giving the support 38 a slightly conical overall shape, the band 40 is stretched farther by a small amount.

Figure 4:
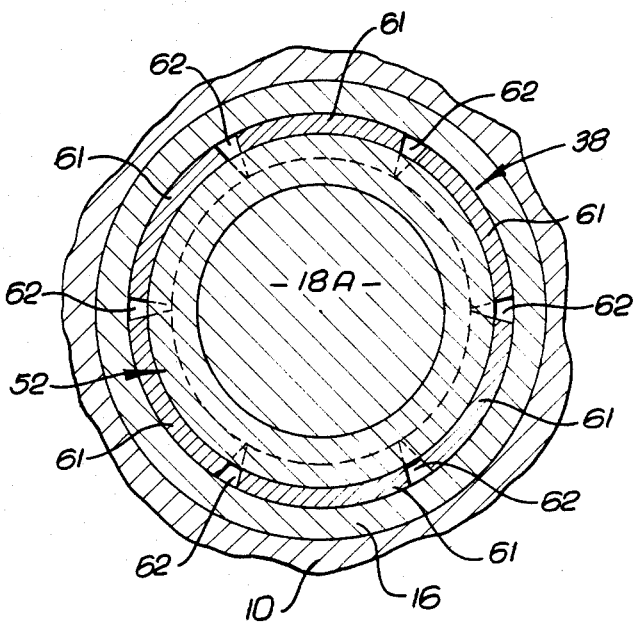
FIG. 4 is a transverse cross-sectional view of the mandrel, tube and tube sheet taken along the line 4—4 of FIG. 3.

The manner in which the support 38 prevents extrusion of the backup member 36 is best understood with reference to FIG. 4. The annular gap that would otherwise be presented to the backup member 36 is largely closed by the lead ends 61 of the support segments, and only small almost rectangular open areas 62 existing between adjacent segments. Not only is the combined size of all extrusion areas greatly reduced, but the shape of these areas 62 is highly advantageous. The sensitivity of materials such as polyurethane to the size and shape of gaps or voids to which they are exposed under pressure is known.

In the absence of the support 38, the unsupported surface of the backup member 36 would be attached to the supported area only along a circular edge and would extend uninterrupted about the entire circumference of the mandrel 18 permitting an annular extrusion. In contrast, the separated, unsupported surfaces of the backup member 36 corresponding to the small gaps 62 are each attached along three of the four sides. Moreover, the maximum unsupported dimension is merely the diagonal of each small area 62, which is almost insignificant when compared to the circumference of the mandrel body 18A. Thus the tendency of the backup member 36 to extrude and deform inelastically at swaging pressure can be effectively eliminated by the presence of the segment support 38.

It should be noted that the small gaps 62 are each of the same size, and it would be disadvantageous if they were not since the tendency of the backup member 36 to extrude destructively is determined by the largest gap presented. Uniformity of the gaps 62 is maintained because the segments of the support 38 cannot rotate about the mandrel body 18A relative to each other. They are locked in relative position because they are in tight contact with each other at the heel ends (the ends away from the pressure zone 28). The location of the band 40 adjacent the heel ends produces a positive action securing the segments in their relative positions with the heels together.

The cam ring 52 tends to center the mandrel 18 within the tube 16. This centering effect takes place because the ring 52 fits closely on the mandrel body 18A and cannot be cocked relative to the body because of its substantial length. It therefore forces each segment of the support 38 to move radially by an equal distance, maintaining the symmetry of the support as it assumes a concial shape. The gaps 62 must therefore be of equal size and the maximum extrusion gap size is minimized.

The apparatus of the present invention can be used repeatedly at high swaging pressures without the need to replace the backup member 36 or any other components. It is of relatively simple and reliable construction considering the pressures at which it is capable of operating and is capable of being reused repeatedly.

While a particular form of the invention has been illustrated and described, it will be apparent that various modifications can be made without departing from the spirit and scope of the invention.

I claim:

1. A hydraulic swaging apparatus for radially expanding a tubular structure comprising:

a mandrel to be inserted axially within said tubular structure, thereby defining an annular pressure zone between said mandrel and said structure, said mandrel also defining a conduit by which a pressurized hydraulic fluid can be introduced into said zone; and a pair of axially separated seal means encircling said mandrel and thereby defining the axial boundaries of said pressure zone, at least one of said seal means comprising (1) a support formed by a plurality of arcuate segments arranged to define a cylinder encircling said mandrel and providing an annular abutment surface facing toward said pressure zone, (2) at least one elastically deformable member encircling said mandrel on the high pressure side of said support to expand radially upon the application of hydraulic pressure thereto, said elastically deformable member interfacing with said abutment surface and being thus restrained against axial deformation, and (3) cam means for spreading said segments of said support in response to said pressure within said zone and thereby expanding said abutment surface radially and preventing inelastic axial deformation of said elastically deformable member.

2. The apparatus of claim 1 further comprising securement means for movably attaching said segments to each other.

3. The apparatus of claim 1 or 2 wherein said segments are substantially inelastic.

4. The apparatus of claim 1 wherein said segments are made of steel.

5. The apparatus of claim 2 or 3 wherein said securement means comprises an elastic band encircling said segments.

6. The apparatus of claim 5 wherein said band is made of polyurethane.

7. A hydraulic swaging apparatus for radially expanding tubular structures comprising:

a mandrel to be inserted axially within said tubular structure, thereby defining an annular pressure zone between said mandrel and said structure, said mandrel also defining a conduit by which a pressurized hydraulic fluid can be introduced into said zone; and a pair of axially separated seals encircling said mandrel and thereby defining the axial boundaries of said pressure zone, at least one of said seals comprising (1) at least one elastic seal member, (2) a support formed by a plurality of arcuate segments arranged to define a cylinder encircling said mandrel and providing an annular abutment surface engaging said elastic member and facing toward said pressure zone, each of said segments having an inclined cam surface thereon, (3) an elastic band encircling said segments and thereby urging said segments against said mandrel, and (4) cam means encircling said mandrel on the high pressure side of said support for engaging said cam surface and for spreading said segments at the ends thereof closest to said pressure zone in response to pressure within said zone and thereby expanding said abutment surface radially and preventing inelastic axial deformation of said elastically deformable member.

8. The apparatus of claim 7 wherein said cam means is an inelastic ring formed separately from said seal member.

9. The apparatus of claim 8 wherein said ring has a foot extending axially along said mandrel to prevent angular movement of said ring relative to said mandrel, said segments defining an annular recess in which said foot is received.

10. The apparatus of claim 8 or claim 9 wherein said cam means has a conical surface thereon configured to engage and mate with said cam surface.

11. The apparatus of claim 7 or 8 wherein there are two of said elastically deformable members one of which is relatively hard and the other of which is relatively soft, said soft member being on the high pressure side of said band member.

12. The apparatus of claim 11 wherein said soft member is an O-ring and said hard member is made of polyurethane.

13. The apparatus of claim 7 wherein said elastic band is made of polyurethane.

14. The apparatus of claim 7 wherein said segments define an annular groove in which said elastic band is disposed.

15. The apparatus of claim 14 wherein said groove is disposed nearer to the low pressure end of said segments and farther from the high pressure end of said segments.

16. A hydraulic swaging apparatus for radially expanding tubular structures comprising:

a mandrel to be inserted axially within said tubular structure, thereby defining an annular pressure zone between said mandrel and said structure, said mandrel also defining a conduit by which a pressurized hydraulic fluid can be introduced into said zone; and a pair of axially separated seals encircling said mandrel and thereby defining the axial boundaries of said pressure zone, at least one of said seals comprising (1) an elastic seal member, (2) a support formed by a plurality of arcuate segments arranged to define a cylinder encircling said mandrel and providing an annular abutment surface facing toward said pressure zone engaged by said elastic member, each of said segments having an inclined cam surface thereon, (3) an elastic band encircling said segments and thereby urging said segments radially inwardly toward said mandrel, and (4) cam means encircling said mandrel on the high pressure said of said support for engaging said cam surface and for spreading said segments at the ends thereof closest to said pressure zone and thereby causing said support to assume a generally conical overall configuration in response to pressure within said zone to enlarge said abutment surface radially and prevent inelastic axial deformation of said elastic member.

17. The apparatus of claim 16 wherein said cam surface is located at the end of said support closest to said pessure zone.

18. The apparatus of claim 17 wherein said groove is disposed nearer to the low pressure end of said segments and farther from the high pressure send of said segments.

19. A hydraulic swaging apparatus for radially expanding a tubular structure comprising:

a mandrel to be inserted axially within said tubular structure, thereby defining an annular pressure zone between said mandrel and said structure, said mandrel also defining a conduit by which a pressurized hydraulic fluid can be introduced into said zone; and a pair of axially separated seals encircling said mandrel and thereby defining the axial boundaries of said pressure zone, at least one of said seals comprising (1) an elastic seal member, (2) a support formed by a plurality of arcuate segments arranged to define a cylinder surrounding said mandrel and providing an annular abutment surface facing toward said pressure zone engaged by said elastic member, said segments defining a circumferential groove on the outer surface thereof, an undercut annular recess extending to the ends of said segments closest to said pressure zone, and a first cam surface at the mouth of said recess, (3) an elastic band disposed within said groove and urging said segments against said mandrel, and (4) cam ring means having a foot extending along said mandrel into said recess and a second cam surface engaging said first cam surface for spreading said segments at the ends thereof closest to said pressure zone to enlarge said abutment surface radially and prevent inelastic axial deformation of said elastic member.

20. The apparatus of claim 19 wherein said cam surfaces are conical.

21. The apparatus of claim 19 wherein said segments and said cam ring are made of inelastic material.

22. The apparatus of claim 19 wherein said groove is disposed nearer to the low pressure end of said segments and farther from the high pressure end of said segments.

23. A hydraulic swaging apparatus for radially expanding a tubular structure comprising:

an elongated generally cylindrical mandrel to be inserted axially within said tubular structure, thereby defining an annular pressure zone between said mandrel and said structure, said mandrel also defining a conduit by which a pressurized hydraulic fluid can be introduced into said zone;

a pair of axially separated seals encircling said mandrel and thereby defining the axial boundaries of said pressure zone, each of said seals comprising (1) a support formed by a plurality of arcuate inelastic steel segments arranged to form a cylinder surrounding said mandrel said support defining a circumferential groove on the outer surface thereof adjacent the end of said ring farthest from said pressure zone, an undercut annular recess opening toward said pressure zone, and a first conical cam surface at the mouth of said recess and at the ends of said segments closest to said pressure zone, (2) an elastic polyurethane band disposed within said groove and urging said segments against said mandrel, (3) inelastic steel cam ring means having an elongated foot extending along said mandrel into said recess and a second conical cam surface engaging said first cam surface for spreading said segments at the ends thereof closest to said pressure zone, (4) an elastically deformable polyurethane backup ring adjacent said cam ring on the side thereof away from said support, and (e) an O-ring that is softer than said backup ring on the side thereof away from said cam ring.

* * * * *